US011587691B2

(12) United States Patent
Koizumi et al.

(10) Patent No.: US 11,587,691 B2
(45) Date of Patent: Feb. 21, 2023

(54) RADIATION-SHIELDING MATERIAL

(71) Applicants: SUN-NANOTECHNOLOGY CO., LTD., Kobe (JP); JAPAN ATOMIC ENERGY AGENCY, Ibaraki (JP)

(72) Inventors: Oji Koizumi, Kobe (JP); Shogo Nasu, Kobe (JP); Junichiro Kamiya, Ibaraki (JP)

(73) Assignees: SUN-NANOTECHNOLOGY CO., LTD., Kobe (JP); JAPAN ATOMIC ENERGY AGENCY, Ibaraki (JP)

( * ) Notice: Subject to any disclaimer, the term of this patent is extended or adjusted under 35 U.S.C. 154(b) by 0 days.

(21) Appl. No.: 16/464,119

(22) PCT Filed: Aug. 9, 2018

(86) PCT No.: PCT/JP2018/029899
§ 371 (c)(1),
(2) Date: May 24, 2019

(87) PCT Pub. No.: WO2019/031578
PCT Pub. Date: Feb. 14, 2019

(65) Prior Publication Data

US 2019/0333653 A1 Oct. 31, 2019

(30) Foreign Application Priority Data

Aug. 9, 2017 (JP) ..... JP2017-154684

(51) Int. Cl.
*G21F 1/10* (2006.01)
*G21F 1/02* (2006.01)
*G21F 1/08* (2006.01)

(52) U.S. Cl.
CPC ..... *G21F 1/106* (2013.01); *G21F 1/02* (2013.01); *G21F 1/085* (2013.01)

(58) Field of Classification Search
None
See application file for complete search history.

(56) References Cited

U.S. PATENT DOCUMENTS 6,265,466 B1 * 7/2001 Glatkowski ..... G21F 1/10 523/137
6,310,355 B1 * 10/2001 Cadwalader ..... A61B 6/107 250/515.1

(Continued)

FOREIGN PATENT DOCUMENTS

JP 2013-127021 A 6/2013
JP 2013127021 A * 6/2013 ..... C08L 101/00

(Continued)

OTHER PUBLICATIONS

Jul. 26, 2022, Japanese Office Action issued for related JP Application No. 2019-535716.

*Primary Examiner* — Michael J Logie
(74) *Attorney, Agent, or Firm* — Paratus Law Group, PLLC

(57) ABSTRACT

A radiation shielding material that is lighter and has lower installation restrictions than conventional methods, and that exhibits excellent shielding efficiency against radiation in the high energy region. The radiation shielding material comprises a complex containing a fibrous nanocarbon material, a primary radiation shielding particle, and a binder, wherein the fibrous nanocarbon material and the primary radiation shielding particle are dispersed in the binder.

2 Claims, 3 Drawing Sheets

(56) References Cited

U.S. PATENT DOCUMENTS

| | | | | |
|---|---|---|---|---|
| 9,475,263 | B1 * | 10/2016 | Rangan | B32B 27/00 |
| 2005/0245667 | A1 | 11/2005 | Harmon et al. | |
| 2009/0298990 | A1 * | 12/2009 | Kim | B82Y 30/00 524/440 |
| 2015/0313044 | A1 * | 10/2015 | Wang | D04C 1/06 2/455 |
| 2016/0027540 | A1 * | 1/2016 | Gordon | G21F 3/00 250/515.1 |
| 2016/0095265 | A1 * | 3/2016 | Huh | D01F 9/14 252/503 |
| 2017/0200518 | A1 * | 7/2017 | Yang | B32B 27/18 |

FOREIGN PATENT DOCUMENTS

| | | | | |
|---|---|---|---|---|
| JP | 2014-130050 | A | 7/2014 | |
| JP | 2014-194405 | A | 10/2014 | |
| JP | 2015-225062 | A | 12/2015 | |
| JP | 2016-183907 | A | 10/2016 | |
| JP | 2017-519205 | A | 7/2017 | |
| WO | WO-9800462 | A1 * | 1/1998 | C08K 3/08 |
| WO | WO 2012/153772 | A1 | 11/2012 | |
| WO | WO-2012153772 | A1 * | 11/2012 | B82Y 30/00 |

* cited by examiner (a)

(b)

(c)

RADIATION-SHIELDING MATERIAL

CROSS REFERENCE TO PRIOR APPLICATION

This application is a National Stage Patent Application of PCT International Patent Application No. PCT/JP2018/029899 (filed on Aug. 9, 2018) under 35 U.S.C. § 371, which claims benefit to Japanese Patent Application No. 2017-154684 (filed on Aug. 9, 2017), which are all hereby incorporated by reference in their entirety.

TECHNICAL FIELD

The present invention relates to a radiation shielding material.

BACKGROUND ART

Establishing a method for storing waste contaminated by radioactive substances generated from nuclear power plants, a method for storing soil or the like generated at the Fukushima nuclear accident following the Great East Japan Earthquake, or a method for reducing outside radiation leakage is a recent significant problem. In the science technology field, the Japan Proton Accelerator Research Complex is expected to be a series of proton accelerators and experimental facilities where frontier research is conducted for particle physics, nuclear physics, material science, life science, nuclear technology, etc. Radiation influence is also a problem in the Japan Proton Accelerator Research Complex. Further, various radiation treatments have been performed in the medical field, and human exposure of radiation from radiation treatment facilities or systems becomes a problem.

Thus, radiation influences are major issues and problems in various fields. However, although radiation exposure to human bodies is a serious problem due to the very high energy and wide range of energy of radioactive rays, including X-rays, α-rays, β-rays, γ-rays, and neutron rays, a solution therefor is considered to be extremely difficult.

A currently discussed radiological countermeasure is a method in which metal, such as lead, tungsten, and iron is processed into plates or blocks, and used as a radiation shielding material, thus protecting human bodies and environments from radioactive rays. Further, a method using a material other than the aforementioned radiation shielding materials has also been considered in which concrete is used for blocking a radiation source, or a concrete wall or container is used for storing a radiation source, thereby avoiding external radiation contamination.

Patent Literature (PTL) 1 discloses a radiation shielding sheet obtained by laminating a layer containing barium sulfate and a thermoplastic resin on a fiber fabric, and the sheet can shield radiation generated from radiation substances. PTL 2 discloses a radiation shielding material obtained by mixing precipitated barium sulfate with a binder formed of an unsaturated polyester resin. Further, for the purpose of providing a lightweight radiation shielding material that is capable of efficiently shielding radiation and is easy to handle, PTL 3 discloses a radiation shielding material using a nanocarbon material.

CITATION LIST

Patent Literature

PTL 1: JP2015-225062A
PTL 2: JP2016-183907A
PTL 3: WO2012/153772

SUMMARY OF INVENTION

Technical Problem

However, the aforementioned method using lead or a like metal in the form of a plate or block as a radiation shielding material has a problem of increased weight of the radiation shielding material. Additionally, a reduction in the thickness of the radiation shielding material to inhibit weight increase results in poor radiation shielding ability; and moreover, the use of lead or a like metal has a bad influence on human bodies and environments. The method using concrete as mentioned above is effective because of its low cost. However, several tens of centimeters to several meters of thickness is required to attenuate radiation; thus, the installation of concrete around an apparatus is highly constrained.

Further, the technique of PTL 1 does not attain sufficient radiation shielding efficiency. In particular, there is room for improvement in efficiently shielding high energy radiation such as Cobalt-60 (60Co). The technique of PTL 2 requires mixing precipitated barium sulfate having a relatively large weight at high concentration, which consequently increases the weight of the radiation shielding material; and the efficiency for shielding high energy radiation is not so high. The technique of PTL 3 also has a problem in increasing the efficiency for shielding high energy radiation such as γ-rays.

The present invention was made in light of the above. An object of the present invention is to provide a radiation shielding material that is lighter and has lower installation restriction than conventional methods, and that exhibits an excellent shielding efficiency against radiation in the high energy region.

Solution to Problem

As a result of extensive research to achieve the above object, the present inventors found that the object can be attained by the use of a complex obtained by dispersing a fibrous nanocarbon material and a radiation shielding particle in a binder. The present invention was thus accomplished.

Specifically, the present invention includes the inventions described in the following items.

1. A radiation shielding material comprising a complex containing a fibrous nanocarbon material, a primary radiation shielding particle, and a binder, the fibrous nanocarbon material and the primary radiation shielding particle being dispersed in the binder.

2. The radiation shielding material according to Item 1, wherein the complex has a density of 0.8 to 3.0 g/cm$^3$.

3. The radiation shielding material according to Item 1 or 2, wherein the complex further comprises a secondary radiation shielding particle having an average particle size smaller than the average particle size of the primary radiation shielding particle, and the secondary radiation shielding particle is dispersed in the binder.

4. The radiation shielding material according to any one of Items 1 to 3, wherein the secondary radiation shielding particle has an average particle size of 10 to 800 nm.

5. The radiation shielding material according to any one of Items 1 to 4, wherein the secondary radiation shielding particle is at least one member selected from the group consisting of tungsten, graphene, carbon nanohorn, and nanographite.

Advantageous Effects of Invention

The radiation shielding material according to the present invention is lighter and has lower installation restriction, and exhibits excellent efficiency for shielding radiation in the high energy region.

DESCRIPTION OF EMBODIMENTS

Figure 1:
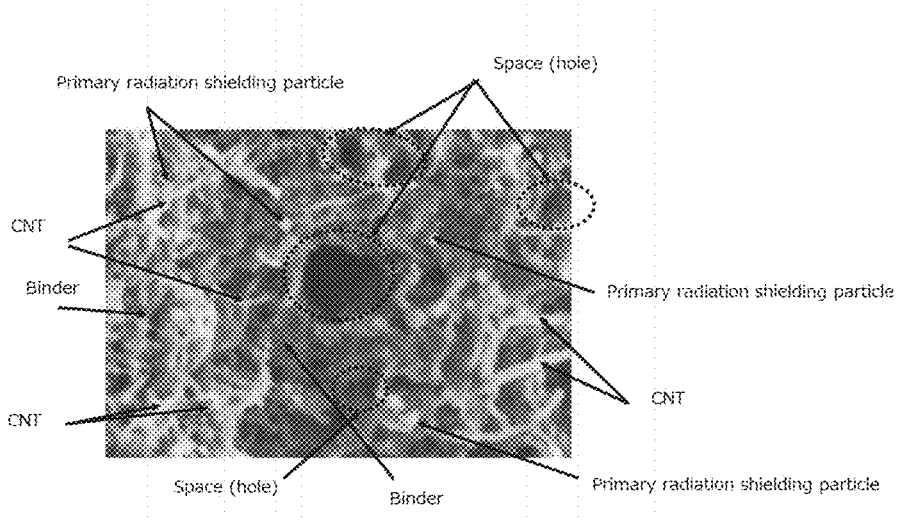
FIGS. 1(*a*), (*b*), and (*c*) respectively show scanning electron microscope (SEM) images of the sample sections obtained in Example 18, Comparative Example 6, and Comparative Example 11.
Figure 1:
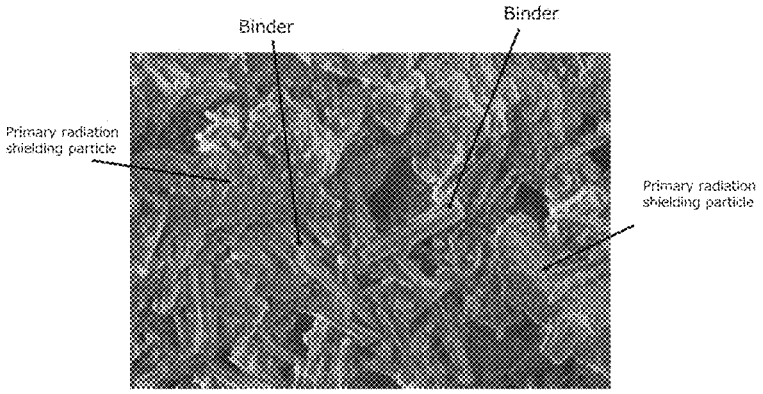
Figure 1:
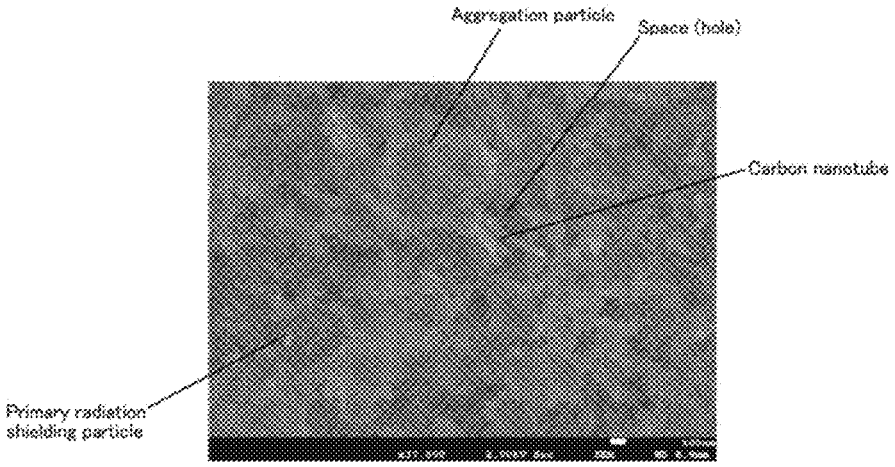

Embodiments of the present invention are explained below. In this specification, the expressions "comprise" and "contain" encompass the concepts of "comprise," "contain," "consist essentially of," and "consist of."

The radiation shielding material of the present invention comprises a complex containing a fibrous nanocarbon material, a primary radiation shielding particle, and a binder. The fibrous nanocarbon material and the primary radiation shielding particle are dispersed in the binder.

The kind of fibrous nanocarbon material is not particularly limited. As long as the nanocarbon material is in a fibrous form, various known nanocarbon materials can be used.

Examples of fibrous nanocarbon materials include carbon nanotubes, carbon nanofibers, carbon fibers, and the like.

When a carbon nanotube is used as a fibrous nanocarbon material, either a single-walled carbon nanotube or a multi-walled carbon nanotube can be used, and both can be used in combination. The diameter and length of the carbon nanotube is not particularly limited. For example, the diameter of the carbon nanotube is 1 to 500 nm, and preferably in the range of 1 to 200 nm. The same applies to the case when the fibrous nanocarbon material is a carbon nanofiber or carbon fiber.

In the fibrous nanocarbon material, other atoms, molecules, or compounds may be included or adsorbed. Examples of such atoms, molecules, or compounds include at least one element selected from the group consisting of calcium, barium, strontium, iron, molybdenum, lead, and tungsten, or a molecule or compound containing such an element.

The fibrous nanocarbon material can be obtained, for example, by the same method as known production methods, or can be obtained from commercially available products.

The kind of primary radiation shielding particle is not particularly limited as long as the primary radiation shielding particle has a radiation shielding property, and various known radiation shielding particles can be used. Examples of the primary radiation shielding particle include particles of compounds, such as barium sulfate, barium carbonate, barium titanate, strontium titanate, and calcium sulfate; particles of metals, such as tungsten, molybdenum, iron, strontium, gadolinium, and barium; particles of oxides containing elements, such as barium, strontium, lead, and titanium; carbon particles, such as graphene, carbon nanohorn, and nanographite; and the like. The primary radiation shielding particles can be used singly or in a combination of two or more.

The primary radiation shielding particle can be obtained through production using a known production method. Alternatively, the primary radiation shielding particle can be obtained from a commercially available product.

The shape of the primary radiation shielding particle is not particularly limited. Examples thereof include, spherical particles, ellipse spherical particles, irregularly deformed heteromorphic particles, and the like.

The average particle size of the primary radiation particle is, for example, in the range of 0.01 to 100 μm. In this range, the radiation shielding material can be easily prevented from increasing its density and overly increasing its weight (mass). The average particle size of the primary radiation particle is preferably in the range of 0.02 to 50 μm. The average particle size herein is the arithmetic mean value obtained by measuring the equivalent circle diameters of 50 primary radiation particles randomly selected by direct observation using a scanning electron microscope (SEM).

The binder is a material for a base material of the radiation shielding material. The binder can also serve as a material for keeping the fibrous nanocarbon material and the primary radiation shielding particle in the radiation shielding material.

The kind of binder is not particularly limited, and various known binders can be used. Examples of materials for forming the binder include inorganic acid-based materials, such as sodium silicate, calcium carbonate, paper clay, clay minerals, layered silicate compounds, pulp, gypsum, cement, mortar, and concrete; and organic-based materials, such as urethane resin, acrylic resin, epoxy resin, nylon resin, polyester resin, polyamide resin, polyolefin resin, ethyl cellulose, methyl cellulose, rubber, and paraffin. The material for forming the binder can be used as a binder by curing. Alternatively, the material for forming the binder can serve as a binder as is. The materials for forming the binder can be used singly or in a combination of two or more.

Examples of the clay mineral include bentonite, smectite, zeolite, bentonite, imogolite, vermiculite, kaoline minerals, talc, and the like. Examples of the layered silicate compound include molybdate, tungstate, and the like.

The material for forming the binder can be obtained by a known method. Alternatively, the material for forming the binder can be obtained from commercially available products.

The proportion ratio of the fibrous nanocarbon material, the primary radiation shielding particle, and the binder in the complex is not particularly limited as long as the effect of the present invention is not impaired.

The amount of the binder is preferably 10 to 70 parts by mass, per 100 parts by mass of the total of the fibrous nanocarbon material, primary radiation shielding particle, and binder. In this range, a lightweight radiation shielding material is likely to be obtained, and the radiation shielding efficiency is easily enhanced.

The amount of the fibrous nanocarbon is preferably 1 to 50 parts by mass, per 100 parts by mass of the total of the fibrous nanocarbon material, primary radiation shielding particle, and binder. In this range, a lightweight radiation shielding material is likely to be obtained, and the mechanical strength is easily improved. Further, the radiation shielding efficiency is easily enhanced; in particular, excellent shielding efficiency against radiation in the high energy region can be attained. The amount of the fibrous nanocarbon is preferably 1 to 40 parts by mass, more preferably 2 to 30 parts by mass, and even more preferably 10 to 30 parts by mass, per 100 parts by mass of the total of the fibrous nanocarbon material, primary radiation shielding particle, and binder.

The amount of the primary radiation shielding particle is preferably 5 to 80 parts by mass, per 100 parts by mass of the total of the fibrous nanocarbon material, primary radiation shielding particle, and binder. In this range, a lightweight radiation shielding material is likely to be obtained, and the radiation shielding efficiency is easily enhanced. In particular, excellent shielding efficiency against radiation in the high energy region can be attained. The amount of the primary radiation shielding particle is preferably 10 to 70 parts by mass, per 100 parts by mass of the total of the fibrous nanocarbon material, primary radiation shielding particle, and binder.

The density of the complex forming the radiation shielding material of the present invention is not particularly limited. For example, the density of the complex can be set to a suitable range to reduce the weight of the radiation shielding material. For example, the density of the complex can be set to 0.8 to 3.0 g/cm$^3$. In this range, since the resulting radiation shielding material has light weight, the radiation shielding material is less sensitive to constraints of installation place or site, and thus can be used in various applications. When the density of the complex is in the above range, the desired radiation shielding efficiency is likely to be obtained.

The density of the complex can be controlled by adjusting the proportion ratio of the fibrous nanocarbon material, primary radiation shielding particle, and binder. In particular, adjusting the amount of the fibrous nanocarbon material is effective for controlling the density of the complex.

In a preferable embodiment, the complex further comprises a secondary radiation shielding particle having an average particle size smaller than that of the primary radiation shielding particle, and the secondary radiation shielding particle is dispersed in the binder. In this case, the radiation shielding material can attain more excellent radiation shielding efficiency.

As long as the secondary radiation shielding particle has a radiation shielding property, the kind of secondary radiation shielding particle is not particularly limited. Various known radiation shielding particles can be used. Examples of the secondary radiation shielding particle include the same as those of the primary radiation shielding particle mentioned above. The secondary radiation shielding particles can be used singly or in a combination of two or more.

In the secondary radiation shielding particle, at least one element selected from the group consisting of calcium, barium, strontium, iron, molybdenum, lead, and tungsten, or a molecule or compound containing such an element may be absorbed or included inside carbon nanohorn, or on the surface or between the layers of carbon atoms of graphene, carbon nanohorn, and nanographite.

The secondary radiation shielding particle is preferably at least one member selected from the group consisting of tungsten, graphene, carbon nanohorn, and nanographite. In this case, the radiation shielding material exhibits excellent shielding efficiency against high energy radiation.

The average particle size of the secondary radiation shielding particle is not particularly limited as long as it is smaller than the average particle size of the primary radiation shielding particle. The secondary radiation shielding particle preferably has an average particle size of 10 to 800 nm because the radiation shielding material is likely to exhibit excellent shielding efficiency against high energy radiation. Since secondary radiation shielding particles having such an average particle size are contained in the complex, the complex is more densely filled with the secondary radiation shielding particles; thus, radiation shielding performance is easily enhanced. The average particle size used herein is the arithmetic mean value obtained by measuring the equivalent circle diameters of 50 secondary radiation particles randomly selected by direct observation using a transparent electron microscope (TEM).

When the complex contains the primary radiation shielding particle and the secondary radiation shielding particle, the average particle size of the primary radiation shielding particle is preferably 0.02 to 50 μm, and more preferably 0.02 to 30 μm while the average particle size of the secondary radiation shielding particle is preferably 10 to 800 nm, and more preferably 10 to 650 nm.

The amount of the secondary radiation shielding particle is preferably 5 to 80 parts by mass, per 100 parts by mass of the total of the fibrous nanocarbon material, primary radiation shielding particle, secondary radiation shielding particle, and binder. In this range, a lightweight radiation shielding material is likely to be obtained, and radiation shielding efficiency is easily enhanced. In particular, excellent shielding efficiency against radiation in the high energy region can be attained. The amount of the secondary radiation shielding particle is more preferably 10 to 70 parts by mass, and even more preferably 10 to 50 parts by mass, per 100 parts by mass of the total of the fibrous nanocarbon material, primary radiation shielding particle, secondary radiation shielding material, and binder.

The shape of the secondary radiation shielding particle is not particularly limited. Examples thereof include spherical particles, ellipse spherical particles, irregularly deformed heteromorphic particles, and the like.

Combinations of the primary radiation shielding particle and the secondary radiation shielding particle contained in the complex are not particularly limited. One combination example is such that the primary radiation shielding particle is at least one particle selected from the group consisting of barium sulfate, barium carbonate, barium titanate, strontium titanate and calcium sulfate, and the secondary radiation shielding particle is at least one member selected from the group consisting of tungsten, graphene, carbon nanohorn, and nanographite because the radiation shielding material is likely to exhibit excellent shielding efficiency against high energy radiation. In particular, a preferable combination is such that the primary radiation shielding particle is barium sulfate and the secondary radiation shielding particle is tungsten.

The state of the fibrous nanocarbon material, primary radiation shielding particle, and optionally contained secondary radiation shielding particle present in the complex is not particularly limited. From the viewpoint of easily enhancing the radiation shielding efficiency, the fibrous nanocarbon material desirably forms a mesh-like structure in the binder. In this case, the mechanical strength of the radiation shielding material is easily enhanced.

It is preferable that the primary radiation shielding particles are uniformly dispersed in the binder. In this case, the primary radiation shielding particles fully exhibit a radiation shielding function; consequently, the radiation shielding material has excellent radiation shielding efficiency. In this specification, uniform dispersion in the binder indicates the state in which there is little or no aggregation of the primary radiation shielding particles in the binder, or the primary radiation shielding particles are distributed through the binder without causing uneven distribution. A preferable state is such that there is little or no aggregation of the primary radiation shielding particles in the binder, and the primary radiation shielding particles are distributed through the binder without causing uneven distribution.

It is preferable that the secondary radiation shielding particles are uniformly dispersed in the binder. In this case, the primary radiation shielding particles fully exhibit a radiation shielding function; consequently, the radiation shielding material has excellent radiation shielding efficiency.

In particular, when the secondary radiation shielding particles are in nano size (e.g., 10 to 800 nm), they are desirably nano-dispersed in the binder. In this case, the radiation shielding material exhibits excellent shielding efficiency against high energy radiation. In the specification, nano dispersion indicates the state in which the secondary radiation shielding particles form little or no aggregation in the order of a few tens of micrometers or more in the binder, and the secondary radiation shielding particles do not cause uneven distribution, and are distributed through the binder while maintaining the nano-size state. In the complex in which the secondary radiation shielding particles are nano-dispersed, the complex is more densely filled; and thus, shielding performance is further enhanced.

The dispersion state in the complex (e.g., nano dispersion) can be confirmed by observation using a scanning electron microscope (SEM) or a transparent electron microscope (TEM); an ultrasonic spectroscopy (ultrasonic attenuation spectroscopy); AC impedance measurement; AC and DC electroconductive tests; etc.

By the method using an SEM or TEM, the mesh-like structure of the fibrous nanocarbon material, and the dispersion state of the primary radiation shielding particle and the secondary radiation shielding particle can be observed. Specifically, the dispersion state can be confirmed from the surface ratio of the mesh-like structure of the fibrous nanocarbon material and the aggregation portion, spaces between meshes, or particle filling properties.

In the method using an ultrasonic spectroscopy (ultrasonic attenuation spectroscopy), ultrasonic irradiation is performed on a sample (complex), and particle size distribution and interparticle interaction of particles (primary radiation shielding particles and/or secondary radiation shielding particles) present in the sample can be measured by the degradation spectrum. Thereby, the nano structure of the radiation shielding material can be confirmed.

The AC and DC electroconductive test methods utilize an advantage that the complex has different electric conductivity depending on the state of meshes of the fibrous nanocarbon material in the sample (complex). For example, when the fibrous nanocarbon materials have sufficient dispersibility, and come into contact with one another to form a mesh-like structure, DC resistance or AC impedance becomes small. In this case, the mechanical strength of the radiation shielding material is enhanced, which increases the radiation shielding efficiency.

However, in the DC electroconductive test, if even a slight conduction path is present in a sample, a current preferentially flows along the conduction path; accordingly, the dispersion state sometimes cannot be fully examined. In this case, the resistance and capacitance inside the sample are measured by the AC impedance method described below, and the dispersion state is determined based on a difference of AC impedance values.

Specifically, in the AC impedance measurement, the values of the real and imaginary parts of impedance are obtained from impedance frequency characteristics; and a nyquist plot is made based on these values. This nyquist plot data explains the impedance behavior of the complex material, and from the impedance behavior, information about the resistance and capacitance is obtained in terms of an equivalent circuit. Thus, the dispersion state of the primary radiation shielding particles and the secondary radiation shielding particles can be determined.

For example, when the impedance value measured by the AC impedance measurement is $1\times10^6\Omega$ or less, the dispersion state of the primary radiation shielding particles and/or the secondary radiation shielding particles is considered to be excellent. Accordingly, the impedance value of the radiation shielding material measured by the AC impedance measurement is preferably $1\times10^6\Omega$ or less.

In addition to having an impedance value of $1\times10^6\Omega$ or less in the nyquist plot according to the AC impedance measurement, the radiation shielding material of the present invention desirably has characteristics of an AC circuit or DC circuit containing capacitance and resistance in terms of an equivalent circuit.

The radiation shielding material of the present invention contains a complex. As long as the effect of the present invention is not impaired, the complex and materials other than the complex are combined to form the radiation shielding material. The radiation shielding material of the present invention may consist of a complex alone.

The radiation shielding material of the present invention can be formed into plates, films, blocks, sheets, rods, balls, ovals, distorted shapes, fibers, pastes, clays, or the like.

The method for producing the radiation shielding material of the present invention is not limited. For example, a fibrous nanocarbon material, a primary radiation shielding particle, a material for forming a binder, and an optionally added secondary radiation shielding particle are mixed in the predetermined ratio, and the resulting mixture is molded by a suitable method to form a complex, thus obtaining a radiation shielding material. One example of the method for producing the radiation shielding material of the present invention is explained below.

The method for producing the radiation shielding material of the present invention comprises step A of preparing a dispersion of a fibrous nanocarbon material, step B of mixing the dispersion, a primary radiation shielding particle, and a material for forming a binder to yield a mixture, and step C of curing the mixture to yield a complex.

In step A, a dispersion in which the fibrous nanocarbon material is dispersed in a solvent is prepared. The kind of fibrous nanocarbon material used in step A is the same as those mentioned above.

Examples of solvents used in step A include water; lower alcohols, such as methanol, ethanol, and iso propyl alcohol; and various organic solvents. The solvent may be a mixed solvent of water and an organic solvent.

The dispersion in which the fibrous nanocarbon material is dispersed in the solvent can be prepared by mixing the fibrous nanocarbon material and the solvent. The mixing method is not particularly limited, and various known mixing means can be used. For example, wet-type media dispersers, such as an ultrasonic device, ultrasonic homogenizer, homogenizer, homomixer, and beads mill; mixing means such as a Nanomizer and Ultimizer can be used. The dispersion can also be prepared by combining several mixing means.

For mixing the fibrous nanocarbon material and the solvent, a dispersant can be used as needed. In step A, various known dispersants can be used. As a dispersant, anionic, cationic, or nonionic surfactants can be used. The kind of surfactant is not limited, and various known surfactants can be used.

When or after the fibrous nanocarbon material is mixed with the solvent, a pH adjuster can be added as needed. The kind of pH adjuster is not particularly limited, and various known pH adjusters can be used.

In step B, the dispersion obtained in step A, a primary radiation shielding particle, and a material for forming a binder are mixed to form a mixture. The kind of primary radiation shielding particle and the material for forming a binder used in step B is the same as those explained above.

The method for obtaining the mixture in step B is not particularly limited. For example, the dispersion obtained in step A is mixed with the primary radiation shielding particle in advance to prepare a preliminary mixture, and then the preliminary mixture is mixed with the material for forming the binder to thereby obtain the mixture.

The preliminary mixture can be prepared by mixing the dispersion obtained in step A and powdery primary radiation shielding particles. Alternatively, the preliminary mixture can be prepared by dispersing powdery primary radiation shielding particles in a solvent in advance, and then mixing the result with the dispersion obtained in step A. The same kind of solvent used in step A can be used. The method for dispersing the primary radiation shielding particle in the solvent is not particularly limited, and known mixing means can be suitably used.

A fibrous nanocarbon material can be additionally added to the preliminary mixture.

The preliminary mixture can be prepared by using the same mixing means as mentioned above.

After obtainment, the preliminary mixture is mixed with a material for forming a binder. Examples of the material for forming a binder used herein include solid materials or liquid materials with viscosity. Alternatively, the material for forming a binder can be dispersed or dissolved in a solvent in advance for use. The kind of solvent used for dispersing or dissolving the material for forming the binder in the solvent is the same as those used in step A. When the material for forming the binder is dispersed or dissolved in the solvent in advance, a dispersant or pH adjuster may be added as needed.

The method for mixing the preliminary mixture and the material for forming the binder is not particularly limited; for example, the mixing means mentioned above can be used. In accordance with the viscosity of the mixture obtained in step B, a stirring mixer, a planetary centrifugal mixer, a three roll mill, etc., can be suitably used.

To produce a complex containing secondary radiation shielding particles, the secondary radiation shielding particles can be mixed with the dispersion obtained in step A. Specifically, the secondary radiation shielding particles can be mixed together with the primary radiation shielding particles in the preparation of the preliminary mixture in step B.

When the secondary radiation shielding particles are used in step B, the secondary radiation shielding particles can be mixed in the form of powders with the dispersion obtained in step A. Alternatively, the powdery secondary radiation shielding particles can be dispersed in a solvent in advance, and then mixed with the dispersion obtained in step A. The same kind of solvent used in step A can be used. The method for dispersing the secondary radiation shielding particles in the solvent is not particularly limited, and known mixing means can be suitably used.

When the material for forming the binder is an organic-based material, the mixture is, for example, obtained in the form of a paste in step B.

In step C, the mixture obtained in step B is cured to obtain a complex.

For curing, a curing agent can be suitably used in accordance with the kind of the material for forming the binder. For example, the curing agent is added to the mixture obtained in step B in advance, and then the mixture is cured to thereby obtain the complex.

The kind of curing agent is not particularly limited, and can be suitably selected in accordance with the kind of material for forming the binder. Various known curing agents can be used.

The method for curing the mixture is not particularly limited. Curing methods used as known methods for curing the material for forming the binder can be widely used. In one method, the mixture is applied in the form of a film or sheet, and then cured. In another example, the mixture is formed into a plate or block using a mold or the like, and then cured. The curing condition is not particularly limited, and curing can proceed by heating the mixture to a suitable temperature. For curing, pressure can be suitably applied.

The complex can be obtained by curing in step C. After curing, drying can be performed by a suitable method. The resulting complex can be molded into a desired shape by using a known molding means. The resulting complex can be used as a radiation shielding material. Alternatively, the resulting complex can be combined with other materials to form a radiation shielding material.

In the method for producing the radiation shielding material of the present invention, the mixture obtained in step B can be formed as a paste composition as mentioned above. Such a composition includes a fibrous nanocarbon material, primary radiation shielding particles, and a material for forming a binder, and optionally includes secondary radiation shielding particles.

The paste composition can also be used as a paste, corking material, and filler for forming the radiation shielding material of the present invention.

Since the radiation shielding material of the present invention includes the complex mentioned above, it is lighter and has lower installation restriction. In particular, the weight of the radiation shielding material of the present invention is greatly reduced compared to that of conventional lead plates or iron plates. Moreover, since the radiation shielding material of the present invention comprises the complex, it exhibits high radiation shielding efficiency, in particular, excellent shielding efficiency against radiation in the high energy region. One reason for attaining such a feature is because the nano structure of the complex is highly controlled. Accordingly, the radiation shielding material of the present invention can shield various types of radiation, such as X-rays, α-rays, β-rays, γ-rays, and neutron rays.

Having the above feature, the radiation shielding material of the present invention can be used for various applications.

For example, the radiation shielding material of the present invention can be used as a shielding plate, shielding block, or shielding wall for radiation source apparatuses, radiation source facilities, and radiation sources of radioactive waste or the like.

The radiation shielding material of the present invention can shield high energy radiation generated in nuclear power plants, accelerator institutions, radioactive waste institutions, and the like. Additionally, the radiation shielding material of the present invention can shield various types of radiation, including X-rays of medical equipment and medical apparatuses; medium energy radiation; and low energy radiation.

EXAMPLES

Hereinafter, the present invention is explained in detail below with reference to Examples. However, the present invention is not limited to the embodiments of the Examples.

Example 1

As a fibrous nanocarbon material, 1 part by mass of a carbon nanotube having a diameter of 10 to 15 nm was added together with a sufficient amount of distilled water to a beaker, followed by stirring and mixing. Thereafter, ultrasonic irradiation was performed for 2 hours using an ultrasonic washing machine set at 28 kHz and then for another 2 hours using an ultrasonic washing machine set at 45 kHz. Thereby, a carbon nanotube aqueous dispersion was obtained (step A).

The carbon nanotube dispersion was introduced into a kneading container, and then carbon nanotube powder having a diameter of 10 to 15 nm was added thereto in a manner such that the total amount of carbon nanotubes after mixing was 10 parts by mass. Additionally, 30 parts by mass of barium sulfate powder (produced by Sakai Chemical Industry Co., Ltd., average particle size: 0.03 μm) was added thereto, followed by preliminary kneading in a high speed mixer for 30 minutes, thereby obtaining a preliminary mixture. Meanwhile, sodium silicate (Fuji Kagaku CORP., sodium silicate No. 1) was added to distilled water, and the pH was adjusted to 10 or above. Thereafter, the result was added to the preliminary mixture obtained above in a manner such that sodium silicate was contained in an amount of 60 parts by mass, and kneading was performed using a high speed mixer. During kneading, the high speed mixer was stopped once to confirm the dispersion state. Kneading using the high speed mixer was performed for a total of one hour, thereby obtaining a mixture (step B).

10 parts by mass of a curing agent ("Rikaset No. 2" produced by Kobe Rikagaku Kogyo Co., Ltd.) was added to the resulting mixture, and kneaded, and then the mixture was put in a mold container and cured (step C). The cured product obtained by curing was cut into a size of 10 cm×10 cm×10 cm, and obtained as an evaluation sample.

Example 2

An evaluation sample was obtained in the same manner as in Example 1 except that the diameter of the carbon nanotube was changed to 40 to 60 nm.

Example 3

An evaluation sample was obtained in the same manner as in Example 1 except that the amounts of barium sulfate powder and sodium silicate to be used were respectively changed to 20 parts by mass and 70 parts by mass in the preparation of a mixture.

Example 4

An evaluation sample was obtained in the same manner as in Example 1 except that the total amount of carbon nanotubes after mixing was changed to 20 parts by mass, and the amounts of barium sulfate powder and sodium silicate to be used were changed to 50 parts by mass and 30 parts by mass in the preparation of a mixture.

Comparative Example 1

30 parts by mass of barium sulfate powder (produced by Sakai Chemical Industry Co., Ltd., average particle size: 0.03 μm) was added to a kneading container. Meanwhile, sodium silicate (Fuji Kagaku CORP., sodium silicate No. 1) was added to distilled water, and the pH was adjusted to 10 or above. Thereafter, the result was added to the kneading container containing the barium sulfate in a manner such that sodium silicate was contained in an amount of 70 parts by mass, and kneading was performed using a high speed mixer. During kneading, the high speed mixer was stopped once to confirm the dispersion state. Kneading using the high speed mixer was performed for a total of one hour, thereby obtaining a mixture.

10 parts by mass of a curing agent ("Rikaset No. 2" produced by Kobe Rikagaku Kogyo Co., Ltd.) was added to the resulting mixture, and kneaded. Subsequently, the mixture was put into a mold container, and cured. The cured product obtained by curing was cut into a size of 10 cm×10 cm×10 cm, and obtained as an evaluation sample.

Comparative Example 2

An evaluation sample was obtained in the same manner as in Comparative Example 1 except that the amounts of barium sulfate powder and sodium silicate to be used were respectively changed to 50 parts by mass and 50 parts by mass in the preparation of a mixture.

Comparative Example 3

An evaluation sample was obtained in the same manner as in Comparative Example 1 except that the amounts of barium sulfate powder and sodium silicate to be used were respectively changed to 80 parts by mass and 20 parts by mass in the preparation of a mixture.

Comparative Example 4

An evaluation sample was obtained in the same manner as in Example 1 except that barium sulfate was not used, and the amount of sodium silicate to be used was changed to 90 parts by mass in the preparation of a mixture.

TABLE 1

| | Amount of CNT (part by mass) | Diameter (nm) | Amount of barium sulfate (part by mass) | Binder | Thickness (cm) | Density (g/cm$^3$) | Shielding efficiency (%) Cs137 661.7 keV | Shielding efficiency (%) 60Co 1173.2 keV | Note (Break, crack) |
|---|---|---|---|---|---|---|---|---|---|
| Example 1 | 10 | 10-15 | 30 | Sodium silicate | 2.5 | 1.97 | 34.6 | 25.0 | A |
| Example 2 | 10 | 40-60 | 30 | Sodium silicate | 3.1 | 1.84 | 36.2 | 22.3 | A |
| Example 3 | 10 | 10-15 | 20 | Sodium silicate | 3.0 | 1.55 | 31.1 | 23.5 | A |
| Example 4 | 20 | 10-15 | 50 | Sodium silicate | 2.5 | 2.05 | 38.5 | 24.6 | A |
| Comparative Example 1 | None | — | 30 | Sodium silicate | 2.7 | 1.98 | 25.5 | 18.6 | B |
| Comparative Example 2 | None | — | 50 | Sodium silicate | 2.9 | 2.21 | 23.4 | 14.3 | B |
| Comparative Example 3 | None | — | 80 | Sodium silicate | 3.1 | 2.45 | — | — | B |
| Comparative Example 4 | 10 | 10-15 | 0 | Sodium silicate | 3 | 1.41 | 16.3 | 5.2 | A |

Table 1 shows the results of the thickness, density, and radiation shielding performance (shielding efficiency) of the evaluation samples obtained in Examples 1 to 4 and Comparative Examples 1 to 4. Table 1 also shows the results of appearance observation of the evaluation samples.

In the appearance observation of the evaluation samples, appearance of the evaluation samples was visually observed to confirm breaks, cracks, and deformation. In Table 1, no breaks, cracks and deformation was rated "A," and at least a break, a crack or deformation was rated "B".

Table 1 indicates that the samples obtained in Examples 1 to 4 exhibit higher radiation shielding efficiency than the samples obtained in Comparative Examples 1 to 4, and also exhibit high shielding efficiency against high energy 60Co γ-rays. A comparison of Examples 1 to 4 and Comparative Examples 1 to 3 also found that the sample tends to be less dense when the carbon nanotube is contained.

The results of Comparative Example 4 indicate that shielding efficiency is low in the absence of barium sulfate.

In the evaluation samples of Examples 1 to 4, breaks, cracks, and changes in shape were not observed while breaks, cracks, and changes in shape were often observed in Comparative Examples 1 to 3. Significant breaks, cracks, and changes in shape were observed as the amount of barium sulfate powder increased.

Thus, it was proved that the radiation shielding material comprising the complex containing the fibrous nanocarbon material (carbon nanotube), primary radiation shielding particle (barium sulfate), and binder (sodium silicate) is lightweight and exhibits excellent shielding efficiency against radiation in the high energy region.

Example 5

As a fibrous nanocarbon material, 1 part by mass of a carbon nanotube having a diameter of 10 to 15 nm was added together with a sufficient amount of distilled water to a beaker, followed by stirring and mixing. Thereafter, ultrasonic irradiation was performed for 2 hours using an ultrasonic washing machine set at 28 kHz and then for another 2 hours using an ultrasonic washing machine set at 45 kHz. Thereby, a carbon nanotube aqueous dispersion was obtained (step A).

The carbon nanotube dispersion was introduced into a kneading container, and then carbon nanotube powder having a diameter of 10 to 15 nm was added thereto in a manner such that the total amount of carbon nanotubes after mixing was 10 parts by mass. Additionally, 30 parts by mass of barium sulfate powder (produced by Sakai Chemical Industry Co., Ltd., average particle size: 0.03 μm) was added thereto, followed by preliminary kneading in a high speed mixer for 30 minutes, thereby obtaining a preliminary mixture. Meanwhile, sodium silicate (Fuji Kagaku CORP., sodium silicate No. 1) was added to distilled water, and the pH was adjusted to 10 or above. Thereafter, the result was added to the preliminary mixture obtained above in a manner such that sodium silicate was contained in an amount of 60 parts by mass, and kneading was performed using a high speed mixer. During kneading, the high speed mixer was stopped once to confirm the dispersion state. Kneading using the high speed mixer was performed for a total of one hour, thereby obtaining a mixture (step B).

10 parts by mass of a curing agent ("Rikaset No. 2" produced by Kobe Rikagaku Kogyo Co., Ltd.) was added to the resulting mixture, and kneaded, and then the mixture was put in a mold container and cured (step C). The cured product obtained by curing was cut into a size of 10 cm×10 cm×10 cm, and obtained as an evaluation sample.

Example 6

As a fibrous nanocarbon material, 1 part by mass of a carbon nanotube having a diameter of 10 to 15 nm was added together with a sufficient amount of distilled water to a beaker, followed by stirring and mixing. Thereafter, ultrasonic irradiation was performed for 2 hours using an ultrasonic washing machine set at 28 kHz and then for another 2 hours using an ultrasonic washing machine set at 45 kHz. Thereby, a carbon nanotube aqueous dispersion was obtained (step A).

The carbon nanotube dispersion was introduced into a kneading container, and then carbon nanotube powder having a diameter of 10 to 15 nm was added thereto in a manner such that the total amount of carbon nanotubes after mixing was 10 parts by mass. Additionally, 20 parts by mass of barium sulfate powder (produced by Sakai Chemical Industry Co., Ltd., average particle size: 10 μm) and 10 parts by mass of tungsten (produced by Japan New Metals Co., average particle size: 0.52 μm) were added thereto, followed by preliminary kneading in a high-speed mixer for 30 minutes, thereby obtaining a preliminary mixture. Meanwhile, sodium silicate (Fuji Kagaku CORP., sodium silicate No. 1) was added to distilled water, and the pH was adjusted to 10 or above. Thereafter, the resultant was added to the preliminary mixture obtained above in a manner such that sodium silicate was contained in an amount of 60 parts by mass, and kneading was performed using a high-speed mixer. During kneading, the high-speed mixer was stopped once to confirm the dispersion state. Kneading using the high-speed mixer was performed for a total of one hour, thereby obtaining a mixture (step B).

10 parts by mass of a curing agent ("Rikaset No. 2" produced by Kobe Rikagaku Kogyo Co., Ltd.) was added to the resulting mixture, and kneaded, and then the mixture was put in a mold container and cured (step C). The cured product obtained by curing was cut into a size of 10 cm×10 cm×10 cm, and obtained as an evaluation sample.

Example 7

An evaluation sample was obtained in the same manner as in Example 6 except that the amounts of barium sulfate powder and tungsten to be used were respectively changed to 10 parts by mass and 20 parts by mass in the preparation of a mixture.

Example 8

An evaluation sample was obtained in the same manner as in Example 6 except that the amounts of barium sulfate powder and tungsten to be used were respectively changed to 0 parts by mass and 30 parts by mass in the preparation of a mixture.

Example 9

An evaluation sample was obtained in the same manner as in Example 5 except that the total amount of carbon nanotubes after mixing and the amount of sodium silicate to be used were respectively changed to 30 parts by mass and 40 parts by mass in the preparation of a mixture.

Example 10

An evaluation sample was obtained in the same manner as in Example 6 except that the amounts of barium sulfate powder and sodium silicate to be used were respectively changed to 30 parts by mass and 50 parts by mass in the preparation of a mixture.

Example 11

An evaluation sample was obtained in the same manner as in Example 5 except that the total amount of carbon nanotubes after mixing was changed to 40 parts by mass, and the amounts of barium sulfate and sodium silicate to be used were respectively changed to 10 parts by mass and 50 parts by mass in the preparation of a mixture.

Example 12

An evaluation sample was obtained in the same manner as in Example 6 except that the amounts of barium sulfate powder and tungsten were respectively changed to 30 parts by mass and 20 parts by mass, and 40 parts by mass of cement (produced by Rix Corporation) was used in place of 50 parts by mass of sodium silicate in the preparation of a mixture.

Example 13

An evaluation sample was obtained in the same manner as in Example 12 except that the amounts of tungsten and cement to be used were respectively changed to 50 parts by mass and 10 parts by mass in the preparation of a mixture.

Example 14

An evaluation sample was obtained in the same manner as in Example 5 except that 60 parts by mass of sodium silicate was changed to 60 parts by mass of paper clay (produced by Kutsuwa Co., Ltd.).

Example 15

An evaluation sample was obtained in the same manner as in Example 6 except that the amount of barium sulfate to be used was changed to 30 parts by mass, and 60 parts by mass of sodium silicate was changed to 50 parts by mass of paper clay (produced by Kutsuwa Co., Ltd.) in the preparation of a mixture.

Example 16

An evaluation sample was obtained in the same manner as in Example 15 except that the amounts of tungsten and paper clay to be used were respectively changed to 20 parts by mass and 40 parts by mass.

Example 17

An evaluation sample was obtained in the same manner as in Example 15 except that the amounts of tungsten and paper clay to be used were respectively changed to 50 parts by mass and 10 parts by mass.

Example 18

An evaluation sample was obtained in the same manner as in Example 12 except that the amounts of cement and tungsten to be used were respectively changed to 60 parts by mass and 0 parts by mass in the preparation of a mixture.

Example 19

An evaluation sample was obtained in the same manner as in Example 12 except that the total amount of carbon nanotubes after mixing was changed to 2 parts by mass, and the amounts of sodium silicate and tungsten were respectively changed to 68 parts by mass and 0 parts by mass in the preparation of a mixture.

Comparative Example 6

An evaluation sample was obtained by curing cement alone.

Comparative Example 7

50 parts by mass of a polyester resin used as a binder was mixed with 50 parts by mass of barium sulfate, and the mixture was cured to obtain an evaluation sample.

Comparative Example 8

70 parts by mass of paper clay used as a binder was mixed with 30 parts by mass of barium sulfate, and the mixture was cured to obtain an evaluation sample.

Comparative Example 9

A lead plate with a thickness of 7.2 mm was obtained as an evaluation sample.

Comparative Example 10

An iron plate with a thickness of 10 mm was obtained as an evaluation sample.

Comparative Example 11

An evaluation sample was obtained in the same manner as in Example 18 except that mixing was conducted by merely shaking a container without using a high-speed mixer in step B.

TABLE 2

| | Amount of CNT (part by mass) | Binder | Amount of barium sulfate (part by mass) | Amount of tungsten (part by mass) | Sample thickness (cm) | Sample density (g/cm$^3$) | Am-241 59.5 keV Shielding efficiency (%) | Am-241 59.5 keV Total attenuation coefficient μ/ρ(cm$^2$/g) |
|---|---|---|---|---|---|---|---|---|
| Ex. 5 | 10 | Sodium silicate | 30 | — | 2.5 | 1.98 | 99.1 | 0.952 |
| Ex. 6 | 10 | Sodium silicate | 20 | 10 | 2.75 | 1.87 | 98.6 | 0.832 |
| Ex. 7 | 10 | Sodium silicate | 10 | 20 | 2.85 | 1.86 | 97.7 | 0.714 |
| Ex. 8 | 10 | Sodium silicate | | 30 | 2.8 | 1.84 | 96.5 | 1.007 |
| Ex. 9 | 30 | Sodium silicate | 30 | — | 3 | 1.2 | 99.2 | 1.116 |
| Ex. 10 | 10 | Sodium silicate | 30 | 10 | 3.03 | 1.9 | 99.4 | 0.897 |
| Ex. 11 | 40 | Sodium silicate | 10 | — | 3.0 | 0.8 | 93.2 | 1.063 |
| Ex. 12 | 10 | Cement | 30 | 20 | 2.87 | 2.6 | 99.9 | 0.926 |
| Ex. 13 | 10 | Cement | 30 | 50 | 2.72 | 3.0 | 99.9 | 1.004 |
| Ex. 14 | 10 | Paper clay | 30 | — | 3.03 | 1.64 | 99.2 | 0.964 |
| Ex. 15 | 10 | Paper clay | 30 | 10 | 2.84 | 1.72 | 99.2 | 0.995 |
| Ex. 16 | 10 | Paper clay | 30 | 20 | 2.68 | 2.05 | 99.2 | 0.883 |
| Ex. 17 | 10 | Paper clay | 30 | 50 | 3.05 | 2.85 | 99.8 | 0.980 |
| Ex. 18 | 10 | Cement | 30 | — | 2.04 | 1.76 | 99.9 | 1.713 |
| Ex. 19 | 2 | Cement | 30 | — | 2.92 | 1.77 | 99.9 | 1.299 |
| Comp. Ex. 6 | None | Cement | — | — | 3.11 | 2.3 | 97.4 | 0.512 |
| Comp. Ex. 7 | None | Polyester resin | 50 | — | 2.56 | 1.95 | 99.0 | 0.925 |
| Comp. Ex. 8 | None | Paper clay | 30 | — | 3.15 | 1.98 | 99.0 | 0.741 |
| Comp. Ex. 9 | — | Lead plate (7.2 mm) | — | — | 0.72 | 11.34 | 99.9 | 1.128 |
| Comp. Ex. 10 | — | Iron plate (10 mm thick) | — | — | 1 | 7.784 | 99.9 | 1.104 |
| Comp. Ex. 11 | 10 | Cement | 30 | — | 2.93 | 1.38 | 91.5 | 0.772 |

| | Cs137 661.7 keV Shielding efficiency (%) | Cs137 661.7 keV Total attenuation coefficient μ/ρ(cm$^2$/g) | 60Co 1173.2 keV Shielding efficiency (%) | 60Co 1173.2 keV Total attenuation coefficient μ/ρ (cm$^2$/g) | 60Co 1332.5 keV Shielding efficiency (%) | 60Co 1332.5 keV Total attenuation coefficient μ/ρ (cm$^2$/g) |
|---|---|---|---|---|---|---|
| Ex. 5 | 32.2 | 0.079 | 27.0 | 0.063 | 25.0 | 0.059 |
| Ex. 6 | 34.0 | 0.08 | 27.0 | 0.06 | 25.0 | 0.055 |
| Ex. 7 | 35.0 | 0.08 | 27.0 | 0.058 | 26.5 | 0.055 |
| Ex. 8 | 35.0 | 0.083 | 27.0 | 0.06 | 25.0 | 0.056 |
| Ex. 9 | 28.0 | 0.055 | 15.0 | 0.045 | 14.0 | 0.042 |
| Ex. 10 | 37.0 | 0.08 | 30.0 | 0.06 | 28.0 | 0.055 |
| Ex. 11 | 17.0 | 0.078 | 13.0 | 0.058 | 11.0 | 0.049 |
| Ex. 12 | 45.0 | 0.080 | 31.0 | 0.050 | 29.0 | 0.048 |
| Ex. 13 | 50.0 | 0.073 | 38.0 | 0.059 | 31.0 | 0.045 |
| Ex. 14 | 33.0 | 0.079 | 25.0 | 0.057 | 23.0 | 0.052 |
| Ex. 15 | 31.0 | 0.076 | 27.0 | 0.062 | 24.0 | 0.058 |
| Ex. 16 | 38.0 | 0.086 | 32.0 | 0.069 | 28.5 | 0.061 |
| Ex. 17 | 49.0 | 0.077 | 35.0 | 0.050 | 31.0 | 0.043 |
| Ex. 18 | 25.4 | 0.082 | 23.8 | 0.076 | 23.1 | 0.073 |
| Ex. 19 | 32.3 | 0.076 | 25.3 | 0.056 | 24.8 | 0.055 |

TABLE 2-continued

| | | | | | | |
|---|---|---|---|---|---|---|
| Comp. Ex. 6 | 14.0 | 0.021 | 9.0 | 0.013 | 7.0 | 0.010 |
| Comp. Ex. 7 | 23.0 | 0.052 | 11.0 | 0.023 | 8.0 | 0.017 |
| Comp. Ex. 8 | 25.9 | 0.048 | 23.0 | 0.041 | 21.0 | 0.038 |
| Comp. Ex. 9 | 52.0 | 0.090 | 33.2 | 0.049 | 30.7 | 0.045 |
| Comp. Ex. 10 | 50.0 | 0.089 | 37.0 | 0.058 | 34.0 | 0.055 |
| Comp. Ex. 11 | 21.3 | 0.045 | 15.5 | 0.033 | 14.2 | 0.031 |

Table 2 shows the results of the thickness, density, and radiation shielding performance (shielding efficiency and total attenuation coefficient) of the evaluation samples obtained in Examples 5 to 17 and Comparative Examples 6 to 10.

Table 2 indicates that the density of the sample can be controlled to 0.8 to 3.0 g/cm$^3$ by adjusting the amount of each material contained in the complex.

Table 2 also indicates that the samples obtained in Examples 5 to 17 exhibit higher radiation shielding efficiency than the samples obtained in Comparative Examples 6 to 8. Additionally, Table 2 indicates that the samples obtained in Examples 5 to 18 exhibit high shielding efficiency against high energy 60Co γ-rays (60Co (1173.2 keV) and 60Co (1332.5 keV)), and thus have radiation shielding performance equivalent to or higher than the shielding efficiency of the lead plate and iron plate obtained in Comparative Examples 9 and 10.

Thus, it was proved that the radiation shielding material comprising the complex containing the fibrous nanocarbon material (carbon nanotube), primary radiation shielding particle (barium sulfate), and binder (sodium silicate, cement, or paper clay) is lightweight and exhibits excellent shielding efficiency against radiation in the high energy region. Additionally, it was also proved that excellent shielding efficiency against high energy radiation is attained when the complex contains a secondary radiation shielding particle (tungsten).

Results of Observation Using a Scanning Electron Microscope

FIGS. 1(*a*), (*b*), and (*c*) respectively show the scanning electron microscope (SEM) images of the sample sections obtained in Example 18 and Comparative Examples 6 and 11.

In the sample obtained in Example 18, which is shown in FIG. 1(*a*), nanosized fibrous carbon nanotubes were uniformly dispersed to form a mesh-like structure, and barium sulfate particles, which are the primary radiation shielding particles, were present between spaces of the mesh. Spaces (holes) were observed, and the size of each space was as small as a few hundred nm or less. In particular, spaces between the fibrous carbon nanotubes were found to be smaller. The presence of such nanosized spaces and low density carbon nanotubes apparently contribute to weight reduction of the radiation shielding material. It is also presumed that the presence of barium sulfate particles between the nanosized spaces provides the radiation shielding material with high radiation shielding efficiency.

In FIG. 1(*b*), micron size spaces (holes) were observed in the sample obtained in Comparative Example 6. The size of the space varies depending on the material composition of the complex, curing conditions during production, etc. The presence of spaces is essential for reducing the sample density for weight reduction; however, radiation easily penetrates when the size of the space is as big as micron size as in the Comparative Examples, which fail to obtain an ability as a radiation shielding material.

In the sample obtained in Comparative Example 11 shown in FIG. 1(*c*), carbon nanotubes, and barium sulfate particles, which are the primary radiation shielding particles, were not uniformly dispersed, and many uneven distribution portions were observed. Further, big spaces (holes) were also observed. Thus, the radiation shielding performance of the sample obtained in Comparative Example 11 was presumably low.

It was proved from the above SEM observation that a lightweight radiation shielding material having a high shielding ability can be obtained by uniformly dispersing fibrous nanocarbon in the radiation shielding material, and making a complex structure (nano structure) in which the radiation shielding particles and binder are uniformly dispersed between the spaces of the fibrous nanocarbon.

AC Impedance Measurement Results

Figure 2A:
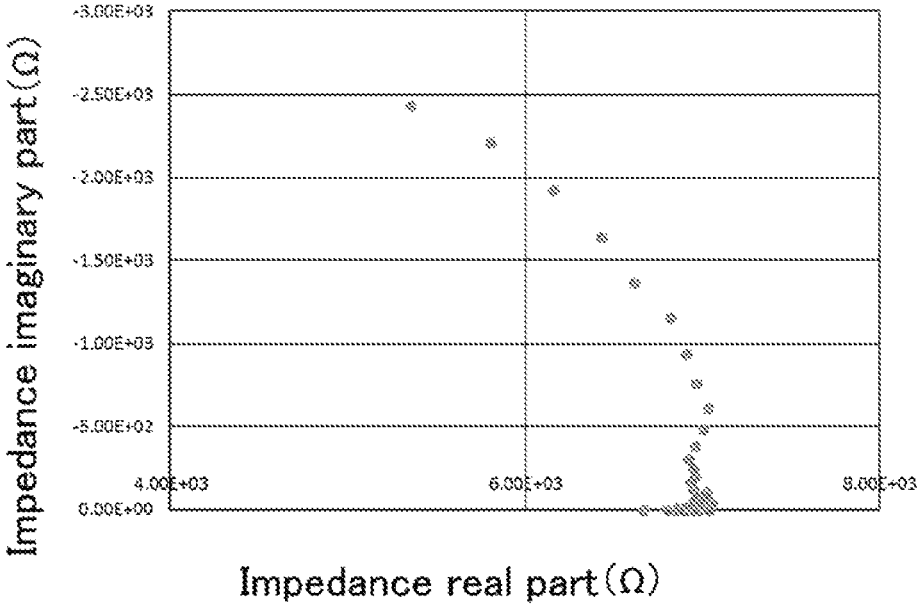
FIGS. 2(*a*) and (*b*) respectively show nyquist plots obtained by AC impedance measurements of the samples obtained in Examples 18 and 19.
Figure 2B:
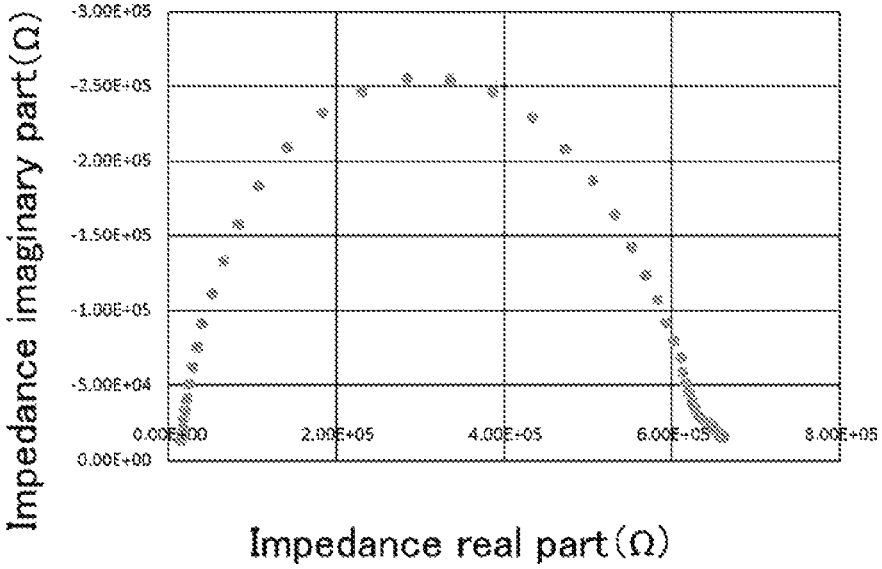
Figure 3A:
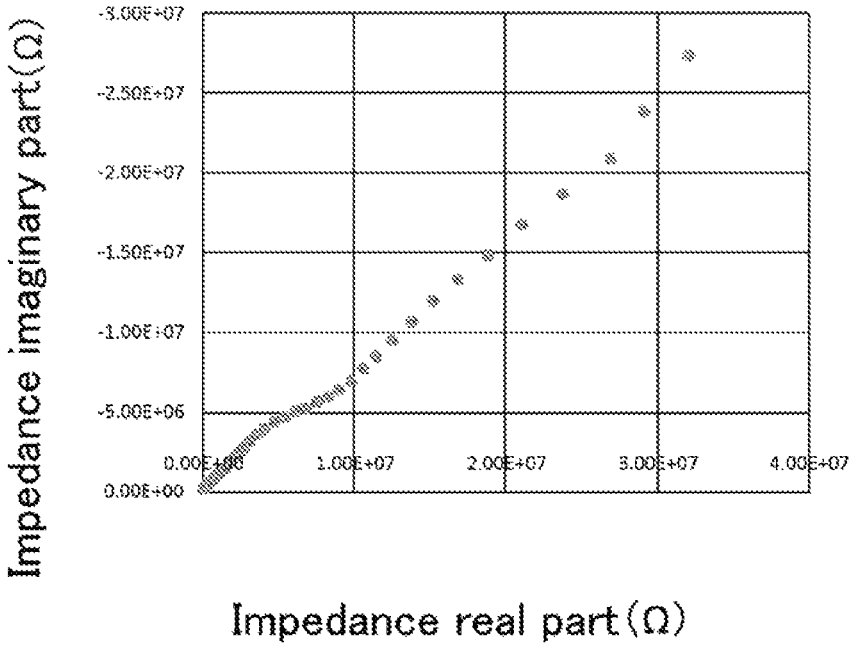
FIGS. 3(*a*) and (*b*) respectively show nyquist plots obtained by AC impedance measurements of the samples obtained in Comparative Examples 6 and 11.
Figure 3B:
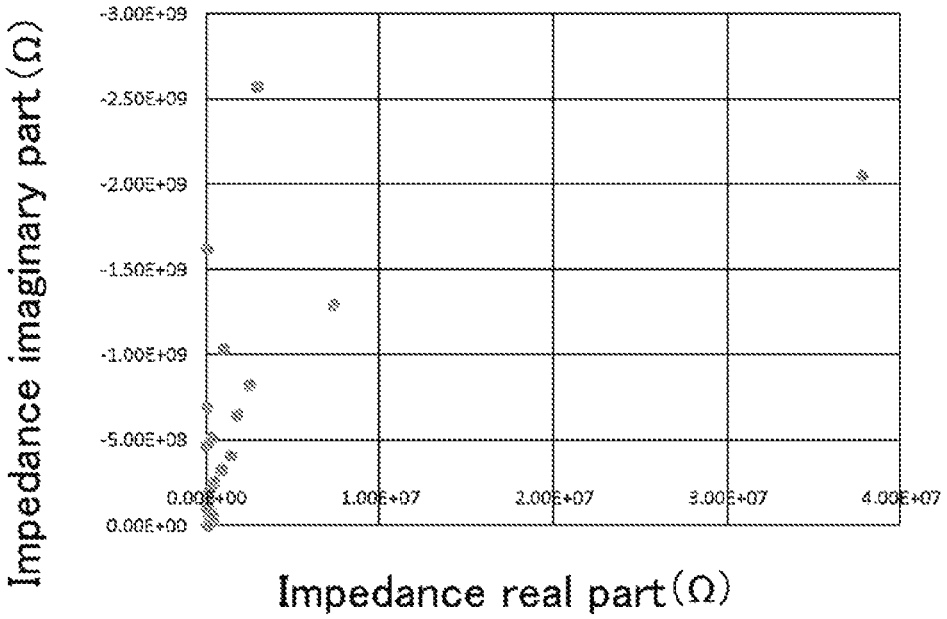

FIGS. 2(*a*) and (*b*) and FIGS. 3(*a*) and (*b*) respectively show nyquist plots obtained by the AC impedance measurement of the samples of Example 18, Example 19, Comparative Example 6, and Comparative Example 11.

FIG. 2(*a*) shows that the nyquist plot of the sample obtained in Example 18 has vertical and arc-like properties. This indicates that the nyquist plot of the sample obtained in Example 18 has characteristics of an AC or DC circuit containing capacitance and resistance in terms of an equivalent circuit.

The impedance value calculated from FIG. 2(*a*) was in the order of $10^3\Omega$ ($1\times10^3$ or more to less than $1\times10^4$).

FIG. 2(*b*) shows that the nyquist plot of the sample obtained in Example 19 has vertical and arc-like properties.

The impedance value calculated from FIG. 2(*b*) was in the order of $10^5\Omega$ ($1\times10^5$ or more to less than $1\times10^6$).

It is considered from FIGS. 2(*a*) and (*b*) that the radiation shielding material in which conductive fibrous nanocarbon and dielectric sulfate barium particles are uniformly dispersed has characteristics of an AC or DC circuit containing capacitance and resistance in terms of an equivalent circuit.

FIG. 3(*a*) indicates that the nyquist plot of the sample obtained in Comparative Example 6 has right-rising linear properties.

The impedance value calculated from FIG. 3(*a*) was in the order of $10^7\Omega$ ($1\times10^7$ or more to less than $1\times10^8$). Since the sample of Comparative Example 6 consists of cement alone, the impedance characteristics result from internal ionic diffusion.

FIG. 3(*b*) indicates that in the nyquist plot of the sample obtained in Comparative Example 11, plots are scattered.

The impedance value calculated from FIG. 3(*b*) was in the order of $10^7\Omega$ in the real part, and in the order of $10^9\Omega$ in the imaginary part. This is presumably because carbon nanotubes have poor dispersibility, and particles are unevenly dispersed; the results of the SEM image in FIG. 1(*c*) are apparently reflected.

The above AC impedance measurement results indicate that the relationship between the nyquist plot according to the AC impedance measurement and the dispersibility in the radiation shielding material is preferably such that there are characteristics of an AC or DC circuit containing capacitance and resistance in terms of an equivalent circuit and the impedance value is small. In this case, in the radiation shielding material, fibrous nanocarbon materials and radiation shielding particles are likely to be nano-dispersed (likely to have a nano structure) in the binder.

Evaluation Method

Radiation Shielding Performance

The radiation shielding material (evaluation sample) was evaluated by a measurement method in which radiation from a shield trace source passes through the evaluation sample, and the peak coefficient is detected by a detector. As a detector, "Ge detector GMX-20180-Plus" produced by SEIKO EG&G CO., LTD. was used. The shield trace sources were amenicium 24 (Am241, energy 59.5 keV), cesium 137 (Cs137, energy 661.7 keV), 60Co (1173.2 keV), and 60Co (1332.5 key). The shielding efficiency and the total attenuation coefficient when measurement was conducted for a certain period of time were derived.

The shielding efficiency was calculated from formula (1) below.

$$\text{Shielding efficiency (\%)}=\{(I-Is)/I\}\times 100 \quad (1)$$

In formula (1), I is the amount of radiation in the absence of a sample, and Is is the amount of radiation in the presence of the sample.

The total attenuation coefficient μ/ρ of the sample was calculated from formula (2) below.

$$\mu/\rho=-\ln(Is/I)\times(1/\rho d) \quad (2)$$

In formula (2), μ indicates the linear absorption coefficient of a sample, I indicates the amount of radiation in the absence of the sample, Is indicates the amount of radiation in the presence of the sample, ρ indicates the density of the sample, and d indicates the thickness of the sample. The sample density was calculated by measuring the mass and the volume of a sample.

Scanning Electron Microscope Observation

As a scanning electron microscope, the "JSM7100F" produced by JEOL Ltd. was used to observe the state of dispersion in the radiation shielding material.

AC Impedance Measurement

The AC impedance measurement of the radiation shielding material was performed by the AC impedance method. A "WAYNE KERR 6500P" high-frequency LCR meter produced by TOYO Corporation was used as a measurement device. An SH2-Z disc-like electrode was used as a probe. A nyquist plot was made based on the values of the real and imaginary parts of impedance obtained from impedance frequency characteristics; and the resistance, capacitance, and equivalent circuit of the radiation shielding material were estimated from the impedance values and plot behavior, thus obtaining impedance values. From the obtained impedance values, the dispersion state of the fibrous nanocarbon material and the radiation shielding particle in the radiation shielding material was evaluated.

INDUSTRIAL APPLICABILITY

The lightweight radiation shielding material of the present invention can be suitably used as a wall material, blocking material, corking material, sheet material, and adhesive of nuclear power plants, accelerator facilities, and radioactive waste facilities; and as a shielding material and filler of medical equipment and medical apparatuses.

The invention claimed is:

1. A radiation shielding material comprising a complex consisting of (i) carbon nanotubes, (ii) barium sulfate particles as radiation shielding particles, (iii) a paper clay as a binder and (iv) curing agent, the carbon nanotubes and the barium sulfate particles being dispersed in the paper clay, the complex having a density of 1.64 g/cm$^3$, and the complex having nanosized holes outside the carbon nanotubes, wherein the carbon nanotubes are present in an amount of 10 parts by mass, wherein the barium sulfate particles are present in an amount of 30 parts by mass, wherein the paper clay is present in an amount of 60 parts by mass and the curing agent is present in an amount of 10 parts by mass.

2. The radiation shielding material according to claim 1, which is capable of shielding 23.0% of γ-rays of 60Co 1332.5 keV, wherein a thickness of the radiation shielding material is 3.03 cm.

* * * * *